United States Patent [19]

Rijnders

[11] 4,441,297

[45] Apr. 10, 1984

[54] PANELLING AND CARRIERS THEREFOR

[75] Inventor: Willem Rijnders, Alblasserdam, Netherlands

[73] Assignee: Hunter Douglas International N.V., Curacao, Netherlands Antilles

[21] Appl. No.: 367,106

[22] Filed: Apr. 9, 1982

Related U.S. Application Data

[63] Continuation-in-part of Ser. No. 267,527, May 27, 1981.

[30] Foreign Application Priority Data

Jun. 17, 1980 [GB] United Kingdom ..... 8019715

[51] Int. Cl.[3] ..... E04B 5/52

[52] U.S. Cl. ..... 52/478; 52/545; 52/763

[58] Field of Search ..... 52/763, 764, 74, 75, 52/78, 478, 474, 578, 579, 489, 762, 774, 780

[56] References Cited

U.S. PATENT DOCUMENTS

| | | | |
|---|---|---|---|
| 2,043,706 | 6/1936 | Myers | 52/387 |
| 2,882,713 | 4/1959 | Diehl | 52/387 |
| 2,946,415 | 7/1960 | Fischer | 52/478 X |
| 3,318,055 | 5/1967 | Piana | 52/478 X |
| 3,916,577 | 11/1975 | Vare | 52/489 |
| 4,134,244 | 1/1979 | Sjolander | 52/478 X |
| 4,288,958 | 9/1981 | Chalmers et al. | 52/478 |

FOREIGN PATENT DOCUMENTS

| | | |
|---|---|---|
| 1256394 | 5/1967 | Fed. Rep. of Germany . |
| 1509446 | 5/1969 | Fed. Rep. of Germany . |
| 1683493 | 5/1970 | Fed. Rep. of Germany . |
| 7014834 | 11/1973 | Fed. Rep. of Germany . |
| 85567 | 7/1965 | France . |
| 1464109 | 12/1966 | France . |
| 478972 | 11/1969 | Switzerland . |
| 1206315 | 9/1970 | United Kingdom . |
| 1489422 | 10/1977 | United Kingdom . |

*Primary Examiner*—Carl D. Friedman

*Attorney, Agent, or Firm*—Pennie & Edmonds

[57] ABSTRACT

A carrier for supporting panelling, the panels of which each have a main panel portion which has inturned side portions on each of two opposite sides, and one side portion has, at its free edge, a rim turned towards the other side portion while the other side portion has at its free edge an arm turned away from the one side portion. The carrier is in the form of an L- or T-shaped body or a body with a central U- or V-shaped cross-section with the body having at least one body portion. A plurality of pairs of lugs are provided on each body portion, the pairs of lugs being longitudinally spaced from one another and the lugs of a pair being laterally spaced and of two types. The first type is substantially rigid and includes a tongue spaced from a surface of the body portion to accommodate the rim of one panel and the arm of an adjacent panel and the second type of lug is mounted on the body portion to hold the arm and rim of two adjacent panels against the tongue of the first type of lug.

14 Claims, 10 Drawing Figures

PANELLING AND CARRIERS THEREFOR

CROSS-REFERENCE TO OTHER APPLICATIONS

This application is a continuation-in-part of my copending application Ser. No. 267,527 filed May 27, 1981.

TECHNICAL FIELD

The present invention relates to panelling and to carriers for supporting panelling.

BACKGROUND AND SUMMARY OF THE INVENTION

One type of panelling has panels which are each formed with a main substantially flat panel portion which has an inturned side portion on each of two opposite sides. One of these side portions has, at its free edge, a rim which is turned inwards and the other side portion has, at its free edge, an arm which is turned away from the one side portion.

These panels are conventionally mounted on carriers which themselves are mounted on a wall or ceiling structure to be clad by the panelling. The flanges of the carriers are conventionally provided with lugs usually all bent down and back parallel to the flanges in the same direction. A panel is mounted with the arm being supported on one lug and the rim on the adjacent lug and the next panel is then introduced so that its arm engages above the rim of the already fitted panel and abuts against the flange, the rim and arm being urged upwardly by the resilience of the lug. This arrangement is generally satisfactory, at least in the short term, in that it provides a pleasant appearance to the panelling, the arm in each case bridging the gap between the main panel portions, so that the carriers cannot be seen.

A problem arises with this construction because, in order to ensure that the panels are held firmly, the lugs are made resilient and urge the panels up against the flanges of the carriers. It will be appreciated that if the panels are removed on one or two occasions to attend to wiring or plumbing or the like behind the panelling, then the lugs will become progressively weakened and experience has shown that very often they tend to snap off. This is, of course, totally unsatisfactory.

However, more elaborate arrangements have been proposed but none of these overcome the basic problem of the system above.

It is now proposed, according to the present invention, to provide a carrier for supporting panelling, the panels of which each have a main panel portion with an inturned side portion on each of two opposite sides, one side portion having at its free edge a rim turned towards the other side portion, and the other side portion having, at its free edge, an arm turned away from the one side portion, said carrier comprising an elongate body securable to a support structure, at least one body portion on said body, a plurality of lugs on each body portion; the lugs being arranged in pairs, with the pairs of lugs being longitudinally spaced from one another and with the lugs of a pair being laterally spaced one on each body portion, the first lug of each pair being substantially rigid and including a tongue spaced from a surface on the associated body portion to accommodate the rim of one panel and the arm of an adjacent panel, the second lug of a pair being mounted on at least one body portion, to hold the arm and rim of adjacent panels against the tongue of the first lug.

Such a structure overcomes the difficulties indicated above, insofar as the rigid first lug of each pair takes up the load of panels and it does not get subjected to any particular high forces during insertion and removal of the panels. The provision of the second lug of each pair which is laterally spaced from the first lug of that pair, ensures that the arm of one panel and the rim of the adjacent panel are together held against the rigid lug respectively. The second lug may be resilient to allow the panels to be inserted but in a preferred construction they are rigid and the inherent resilience of the panels will permit flexing thereof to allow the panels to be inserted and retain the panels held against the first lugs.

In a preferred construction the lugs are arranged in two substantially parallel longitudinally extending rows and the lugs in each row are preferably alternately of one type and of the other type. Two rows of lugs of each type may also be provided in "double pairs", the lugs of a pair being different or the lugs of a pair being the same but different from the other pair.

The body may take many forms. For example it may be simply the upright of an L with a body portion providing with this upright an L-shaped cross-section.

Another form of carrier is of generally inverted, V- or U-shaped cross-section or of T-shaped cross-section, there being two legs forming said body portions either forming the arms of the T or the upstanding sides of the V or U and diverging away from one another. When the second lugs are rigid, the inverted V- or U-shaped cross-section carriers may have flanges provided with the lugs and forming part of the body portions to give added resilience to the carriers to further enable the panels to be mounted and demounted. The body and flanges may be formed from a single flat sheet by rolling.

Whichever form the carrier takes, the lugs are advantageously formed by punching out of the associated body portion whereby they include a connecting portion and tongue, and preferably, but not exclusively, for the first lugs, both the connecting portion and tongue are provided with a reinforcing rib.

The second lugs may be punched out of the associated body portion whereby they include a connecting portion and a leg, the leg being engageable with the arm of a panel to urge it towards the tongue of the associated first lug.

With this arrangement the leg may have adjacent to, but spaced from its free end a projection which is adapted to engage behind a bead formed on the arm of a panel. This bead will be held in engagement with the connecting portion of the first lug by the projection which will make removal accidentally more difficult. Thus the projection and bead form a type of latch which holds the panels in place. To "hold" comprising: 'urging', 'touching', or 'with some play'.

The leg of the second lug of a pair may extend from its connecting portion in the opposite direction or in the same direction to that which the tongue of the first leg of that pair extends.

The invention also provides a panelling system comprising panels which each have a main panel portion with an inturned side portion on each of the two opposite sides, one side portion having at its free edge a rim turned towards the other side portion and the other side portion having at its free edge an arm turned away from said one side portion, a plurality of carriers each comprising an elongate body securable to the support structure, at least one body portion on said body, a plurality of lugs on said body portion, the lugs being arranged in pairs with the pairs of lugs being longitudinally spaced from one another and with the lugs of a pair being laterally spaced the first lug of each pair being substantially rigid and including a tongue spaced from a surface of the body portion to accommodate the rim of one panel and the arm of the adjacent panel, the second lug of a pair being mounted on the body portion to urge the arm and rim of adjacent panels against the tongue of said first lug.

DESCRIPTION OF THE DRAWINGS

In order that the invention may more readily be understood, the following description is given, merely by way of example, reference being made to the accompanying drawings, in which.

DESCRIPTION OF THE INVENTION

Figure 1:
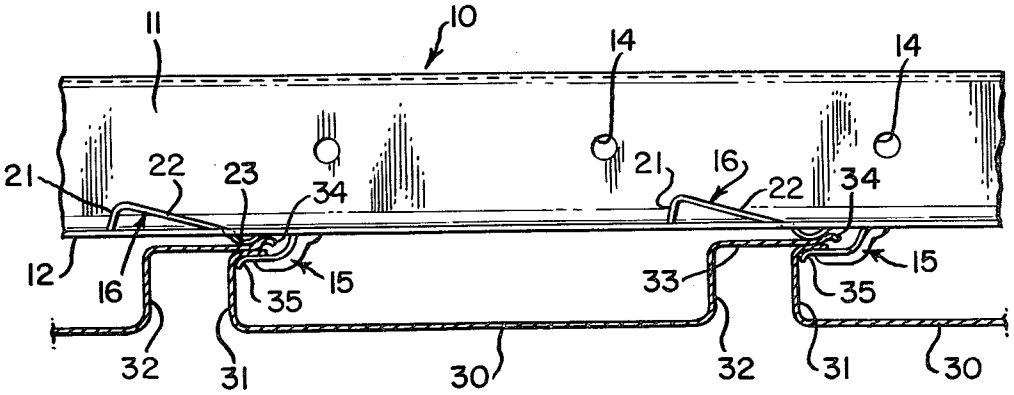
FIG. 1 is a side elevation of one embodiment of the carrier and panelling according to the invention.

Referring first to FIG. 1 of the drawings, there is illustrated a carrier 10 which comprises a body 11 of inverted U-shaped cross-section provided with two body portions 12 and 13 which extend outwardly away from one another from the free ends of the U-shaped body. As can be seen more clearly in FIG. 1, the body has openings 14 to enable the carrier to be supported.

The body portions 12 and 13 are each provided with a longitudinally extending row of lugs. The lugs alternate so that they include a first type of lug 15 and a second type of lug 16.

It will be noted that the lugs 15 of the body portion 12 are laterally spaced from the lugs 16 of the body portion 13. Similarly the lugs 15 of the body portion 13 are laterally spaced from the lugs 16 of the body portion 12. Therefore, the carrier as a whole has longitudinally spaced pairs of lugs, the lugs of a pair being laterally spaced with respect to one another and one lug of the pair being of the first type and one lug of the pair being of the second type.

Both the lugs 15 and 16 are punched out of the body portions 12 and 13. The lugs 15 are rigid lugs and consist of a connecting portion 17 and a tongue 18. Both the connecting portion and the tongue are reinforced by a rib 19 to make the lug rigid. It will be noted that the free end 20 of the tongue is bent down to provide a curved end portion extending away from the body portions 12 and 13.

The lugs 16 have a connecting portion 21 and an elongate leg 22 which is provided with a projection 23 which is adjacent to but spaced from the free end of the leg.

As shown in FIG. 1, the panels which the carrier supports include a main portion 30 which is substantially flat and side portions 31 and 32. The side portion 32 is provided with an arm 33 which extends away from the side portion 31 and is formed, adjacent its free end, with a bead 34.

The other side arm 31 has an inturned rim 35.

In order to mount the panels on the carrier, the first of the panels is engaged so that its arm is above one rigid lug 15 and the rim is above another of the lugs 15 and the panel is moved to the right, as seen in FIG. 1. The next panel is then taken and its arm is pushed above the rim 35 of the previously assembled panel and so that its bead engages the leg of the lug 16 thereabove. The leg, being somewhat longer than the tongue, is resilient and flexes upwardly until the bead 34 has gone beyond the projection 23 which then snaps down behind the bead. At the same time the rim engages behind the next tongue 18. The panelling system is built up successfully in this way.

The curved down end portion 20 facilitates the introduction of the arm 33 and of the rim 35.

Figure 2:
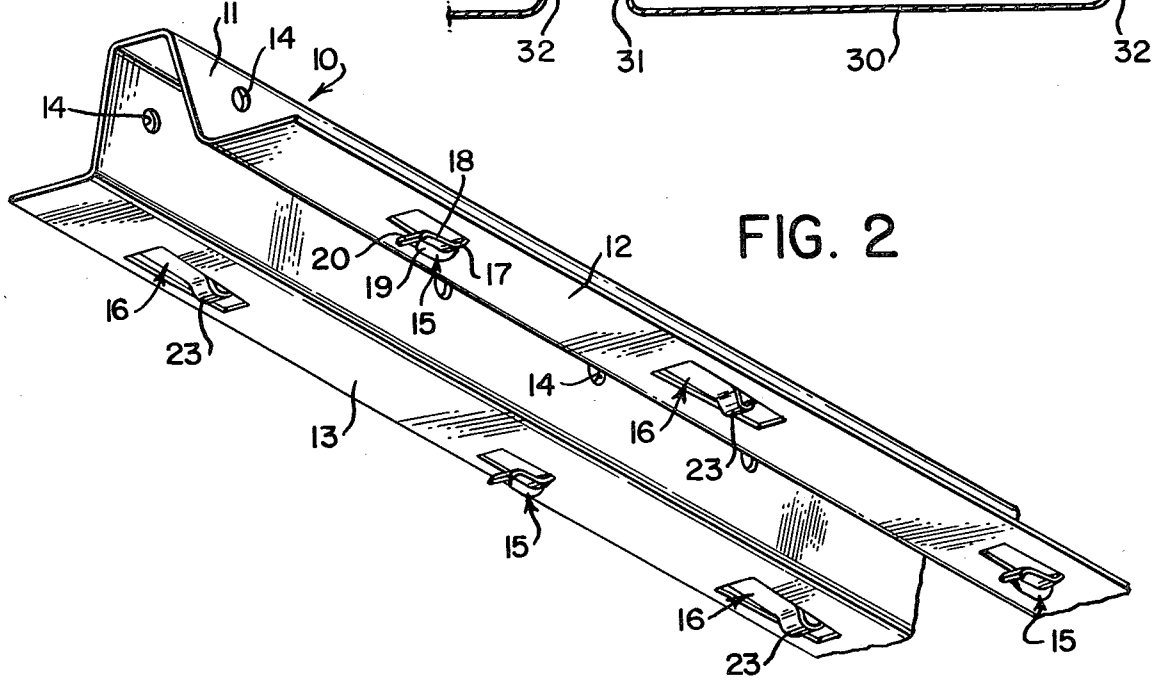
FIG. 2 is a perspective underneath view of the carrier of FIG. 1.
Figure 3:
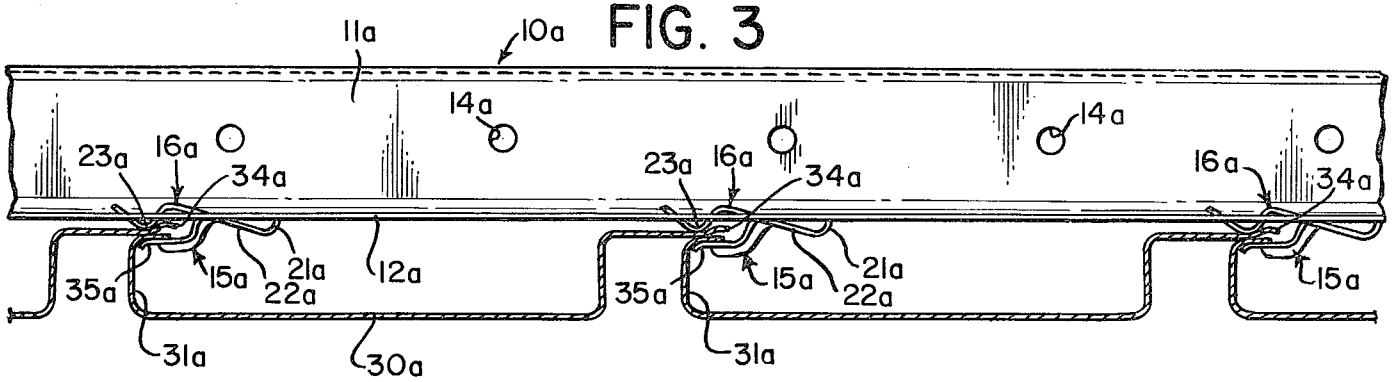
FIGS. 3 and 4 and FIGS. 5 and 6 are similar views to FIGS. 1 and 2 of two modified constructions.
Figure 4:
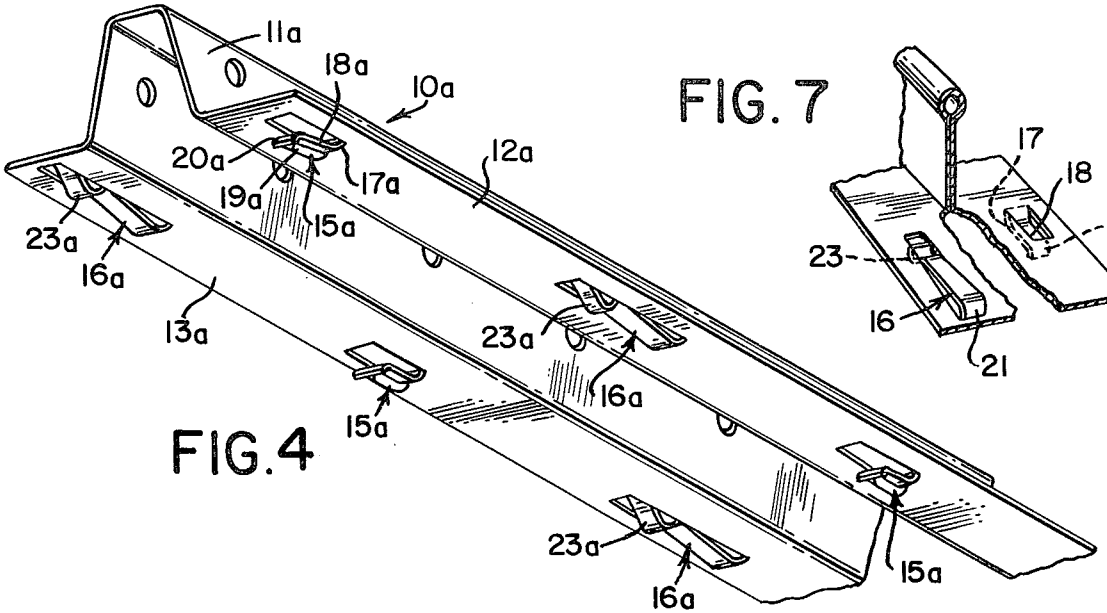

The construction shown in FIGS. 3 and 4 is generally similar except here the connecting portions of the lugs 16*a* are at the same end as the connecting portions of the lugs 15*a*. The construction of FIGS. 3 and 4, therefore, is easier to insert the panels but more difficult to remove and the construction of FIGS. 1 and 2 the other way around.

The effect of the resilient lug 16 is to facilitate the introduction of the arms of the panels but at the same time to hold the arm of one panel and the rim of the adjacent panel firmly against the lug to prevent any rattling. Since the lugs 15 are rigid, there will be little tendency for these lugs to be snapped off upon repeated insertion and removal of the panels.

Figure 5:
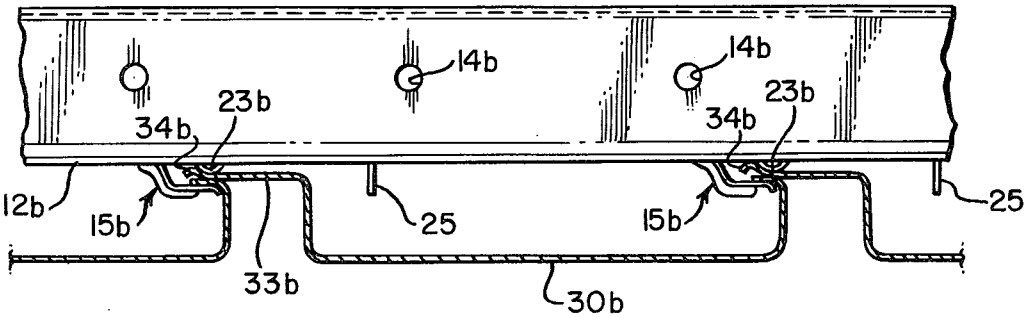
Figure 6:
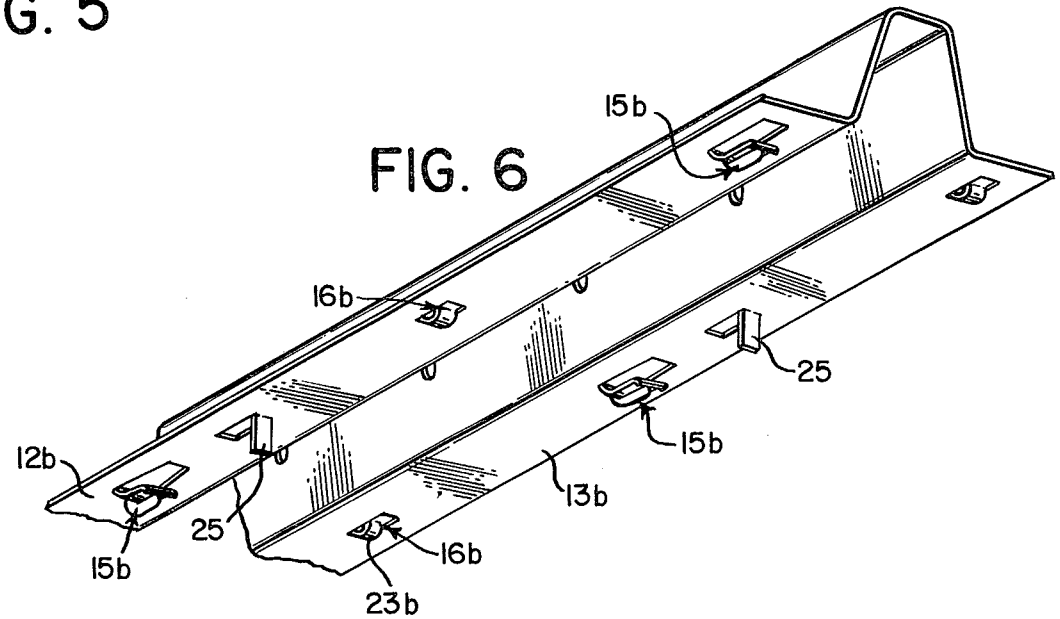

FIGS. 5 and 6 show a further arrangement in which both the first and second lugs 15*b* and 16*b* are made rigid. The lugs 16*b* will press on the top of the arms 33*b* of the panels and will urge the panels against lubs 15*b*. The resilience of the flanges 12*b*, 13*b* and/or of the arms 33*b* will allow a slight flexing thereof to cause resilient urging of the panels against the lugs 15*b*, thereby preventing rattling and facilitating insertion and removal of the panels.

Vertically extending lugs 25 are provided to prevent a panel being moved too far away from lugs 15*b* when the panel is being inserted or removed thereby insuring that the adjacent panel is not disturbed.

Figure 8:
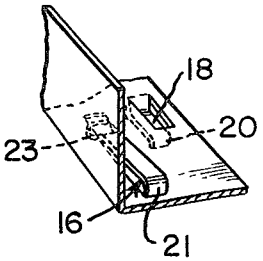
FIGS. 7 and 8 are schematic perspective scrap portions of two further embodiments of the carrier according to the invention.
Figure 7:
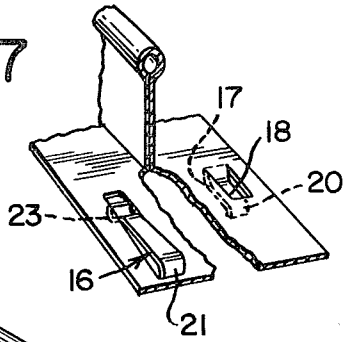

FIGS. 7 and 8 are generally similar to either FIGS. 1 and 2, except that instead of having an inverted U- of V-shaped body portion, the carrier is of a generally T-shaped cross-section in FIG. 7 and of a generally L-shaped cross-section in FIG. 8. It will be noted that the cross-section of FIG. 7 is formed by rolling over a single sheet of material so that it is generally conventional carrier of this type.

Figure 9:
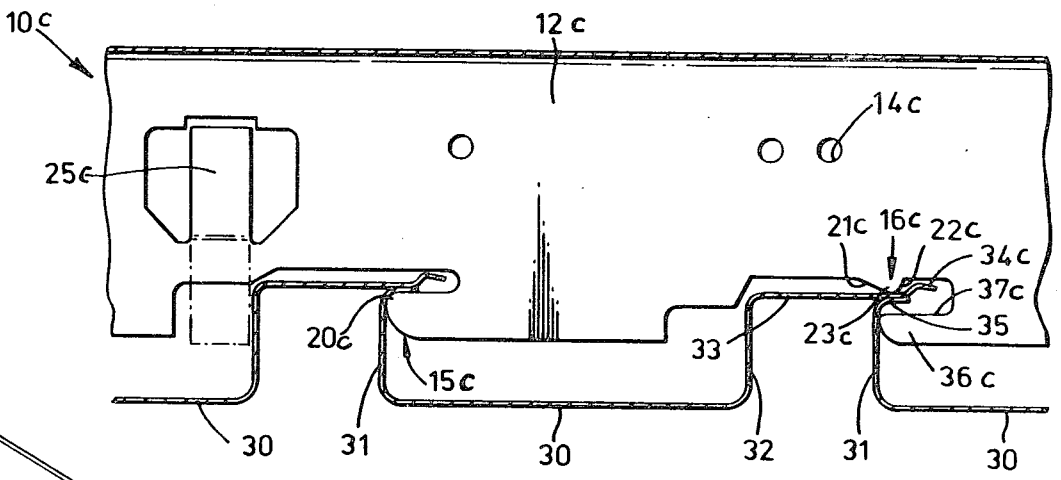
FIG. 9 is a side view of a further embodiment of the carrier and panel according to the invention.
Figure 10:
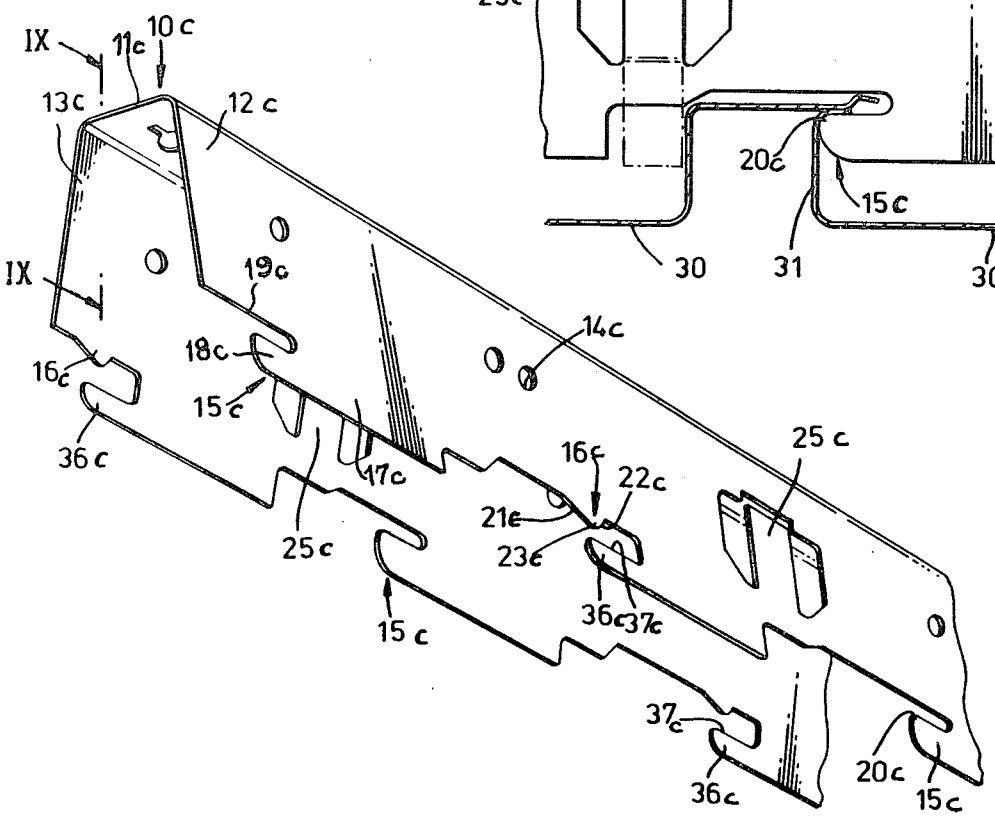
FIG. 10 is a perspective underneath view of the carrier of FIG. 9.

Referring to FIG. 9 of the drawings, there is illustrated a further embodiment of a carrier 10*c* which comprises a body 11*c* of inverted U-shaped cross-section provided with two body portions in the form of legs 12*c* and 13*c* which diverge outwardly away from one another at an angle of approximately 20°. The body has openings 14*c* to enable the carrier to be supported.

The legs 12*c* and 13*c* are each provided with a longitudinally extending row of lugs. The lugs alternate so that they include a first type of lug 15*c* and a second type of lug 16*c*.

It will be noted that the lugs 15*c* of the leg 12*c* are laterally spaced from the lugs 16*c* of the leg 13*c*. Similarly the lugs 15*c* of the leg 13*c* are laterally spaced from the lugs 16c of the leg 12c. Therefore the carrier as a whole has longitudinally spaced pairs of lugs, the lugs of a pair being laterally spaced with respect to one another and one lug of the pair being of the first type and one lug of the pair being of the second type.

Both the lugs 15c and 16c are punched out of the legs 12c and 13c. The lugs 15c are rigid lugs and consist of a connecting portion 17c and a tongue 18c which is spaced from a surface 19c on the leg. It will be noted that the free end 20c of the tongue is rounded to facilitate access to the space behind the tongue.

The lugs 16c are in the form of a gently sloping surface 21c and a steeper surface 22c meeting to provide a projection 23c.

As shown in FIG. 9 the panels which the carrier supports are similar to the panels of FIG. 1. The space between a tongue 18c of the first lug 15c and the surface 19c is sufficient to accommodate the arm of one panel and the rim of the next panel.

In order to mount the panels on the carrier, the first of the panels is engaged so that its arm is above one rigid lug 15c, the rim is above another of the lugs 15c and the panel is moved to the right as seen in FIG. 9. The next panel is then taken and its arm is pushed above the rim 35 of the previously assembled panel and so that its bead engages sloping surface 21c of the lug 16c thereabove. The arm being somewhat longer than the tongue is resilient and flexes downwardly until the bead 34 has gone beyond the projection 23c. At the same time the rim of this panel engages behind the next tongue 18c. The panelling system is built up successfully in this way.

The rounded end portion 20c facilitates the introduction of the arm 33 and of the rim 35.

Vertically extending lugs 25c may be bent down behind an already fitted side portion 32 to prevent a panel being moved too far away from the lugs when the panel is being inserted or removed, thereby ensuring that the adjacent panel is not disturbed.

In the drawings there are illustrated further lugs 36c which are positioned below the second lugs 16c. The height of the tongues 36c is somewhat less than the height of the tongues forming the first lugs 15c, the further tongues 36c having an upper surface 37c which is spaced a significant distance below the projection 23c. Thus, in use, the tongues 36c do not normally touch the rims 35 of the panels 30 but are spaced therefrom. Panelling of this type can be used externally and in high wind conditions there can be a tendency for the panels to be sucked down. The purpose of the further lugs 36c is to prevent such a sucking effect disengaging the panels from the carriers. The provision of these lugs 36c therefore is not essential but is preferable if the carriers are to be used externally.

I claim:

1. A carrier adapted to support adjacent panels of thin material in overlapping position where each of said panels has a main panel portion with an inturned side portion on each of two opposite sides; one side portion having a rim at its free edge turned towards the other side portion, and the other side portion having an arm at its free edge turned away from the one side portion, characterized in that said carrier comprises an elongate body adapted to be secured to a support structure and adapted to support said panels in their overlapping position, a plurality of lugs on said body, the lugs being arranged in pairs, with the pairs of lugs being spaced from one another along the length of said carrier and with the lugs of a pair being spaced from one another along the width of said carrier, the first lug of each pair being substantially rigid and including a tongue adapted to support the rim of one panel and the arm of an adjacent panel, the second lug of a pair being adapted to hold the arm and rim of said adjacent panels in position at the tongue of the first lug.

2. A carrier according to claim 1 wherein there are two body portions and one lug of a pair is arranged on one body portion and the other lug of said pair is arranged on the other body portion.

3. A carrier according to claim 1 wherein both lugs of a pair are arranged on the same body portion.

4. A carrier according to claims 2 or 3 wherein the lugs are arranged in two substantially parallel longitudinally extending rows and the first and second lugs of consecutive pairs are alternately in one row and in the other row.

5. A carrier according to claims 2 or 3 wherein the second lugs of a pair are substantially rigid.

6. A carrier according to claims 2 or 3 wherein the second lugs of a pair are resilient.

7. A carrier for supporting panelling, the panels of which each have a main panel portion with an inturned side portion on each of two opposite sides, one side portion having at its free edge a rim turned towards the other side portion, and the other side portion having, at its free edge, an arm turned away from the one side portion, said carrier being characterized in that it comprises an elongate body securable to a support structure; at least one body portion carried by said body; a plurality of lugs on each said body portion; the lugs being arranged in pairs, with the pairs of lugs being longitudinally spaced from one antoher and with the lugs of a pair being laterally spaced, the first lug of each pair being substantially rigid and including a tongue spaced from a surface of the body portion to accommodate the rim of one panel and the arm of an adjacent panel, the second lug of a pair being mounted on said body portion to hold the arm and rim of adjacent panels against the tongue of the first lug, said first and second lugs being formed by punching out of the associated body portion with the first lugs including a connecting portion and said tongue including a reinforcing rib and with the second lug including a connecting portion and a leg, the leg being engageable with the arm of a panel to urge it towards the tongue of the associated first lug.

8. A carrier according to claim 7 wherein the leg has adjacent to and spaced from its free end a projection adapted to engage behind a bead formed on the arm of a panel.

9. A carrier according to claim 7 wherein the leg of a second lug of a pair extends from its connecting portion in the opposite direction to that which the tongue of the first lug of that pair extends.

10. A carrier according to claim 7 wherein the leg of a second lug of a pair extends from its connecting portion in the same direction as that which the tongue of the first lug of the pair extends.

11. A carrier for supporting panelling, the panels of which each have a main panel portion with an inturned side portion on each of two opposite sides, one side portion having at its free edge a rim turned towards the other side portion, and the other side portion having, at its free edge, an arm turned away from the one side portion, said carrier being characterized in that it comprises an elongate body securable to a support structure; at least one body portion carried by said body; a plurality of lugs on each said body portion; the lugs being arranged in pairs, with the pairs of lugs being longitudinally spaced from one another and with the lugs of a pair being laterally spaced, the first lug of each pair being substantially rigid and including a tongue spaced from a surface of the body portion to accommodate the rim of one panel and the arm of an adjacent panel, the second lug of a pair being mounted on said body portion to hold the arm and rim of adjacent panels against the tongue of the first lug, each pair of lugs having associated therewith a further vertically extending lug positioned to prevent a panel being moved too far away from the first and second lugs of the pair when the panel is being inserted or removed to ensure that the adjacent panel is not disturbed.

12. A carrier for supporting panelling, the panels of which each have a main panel portion with an inturned side portion on each of two opposite sides, one side portion having at its free edge a rim turned towards the other side portion, and the other side portion having, at its free edge, an arm turned away from the one side portion, said carrier being characterized in that it comprises an elongate body securable to a support structure; at least one body portion carried by said body; a plurality of lugs on each said body portion; the lugs being arranged in pairs, with the pairs of lugs being longitudinally spaced from one another and with the lugs of a pair being laterally spaced, the first lug of each pair being substantially rigid and including a tongue spaced from a surface of the body portion to accommodate the rim of one panel and the arm of an adjacent panel, the second lug of a pair being mounted on said body portion to hold the arm and rim of adjacent panels against the tongue of the first lug and having a further tongue adjacent to and spaced from each second lug the free end of said further tongue being in use adjacent one side portion of a mounted panel and the surface of the further tongue facing the associated second lug being spaced from the rim of said panel.

13. A panelling system comprising panels having overlapping portions which each have a main panel portion with an inturned side portion on each of the two opposite sides, one side portion having at its free edge a rim turned towards the other side portion and the other side portion having at its free edge an arm turned away from said one side portion and a plurality of carriers supporting the panels; characterized in that the carriers each comprise an elongate body securable to the support structure and adapted to support said panels in their overlapping position, at least one body portion carried by said body, a plurality of lugs on each said body portion; the lugs being arranged in pairs, with the pairs of lugs being longitudinally spaced from one another and with the lugs of a pair being laterally spaced, the first lug of each pair being substantially rigid and including a tongue spaced from a surface of the body portion to accommodate the rim of one panel and the arm of an adjacent panel, the second lug of a pair being mounted on the body portion to hold the arm and rim of adjacent panels against the tongue of said first lug.

14. A panelling system comprising panels which each have a main panel portion with an inturned side portion on each of the two opposite sides, one side portion having at its free edge a rim turned towards the other side portion and the other side portion having at its free edge an arm turned away from said one side portion and a plurality of carriers supporting the panels; characterized in that the carriers each comprise an elongate body securable to the support structure, at least one body portion carried by said body, a plurality of lugs on each said body portion; the lugs being arranged in pairs, with the pairs of lugs being longitudinally spaced from one another and with the lugs of a pair being laterally spaced, the first lug of each pair being substantially rigid and including a tongue spaced from a surface of the body portion to accommodate the rim of one panel and the arm of an adjacent panel, the second lug of a pair being mounted on the body portion to hold the arm and rim of adjacent panels against the tongue of said first lug and in that the second lugs include a projection engaging the arm of a panel to hold it against the tongue of the associated first lug and in that the arm of the panel is provided with a bead with said projection engaging behind the bead to resist removal of the arm from the lugs.

* * * * *